US011130923B2

(12) United States Patent
Hansch et al.

(10) Patent No.: US 11,130,923 B2
(45) Date of Patent: Sep. 28, 2021

(54) ALKOXYLATED AMINES AS FUEL ADDITIVES

(71) Applicant: BASF SE, Ludwigshafen am Rhein (DE)

(72) Inventors: Markus Hansch, Ludwigshafen (DE); Jochen Mezger, Ludwigshafen (DE)

(73) Assignee: BASF SE

( * ) Notice: Subject to any disclaimer, the term of this patent is extended or adjusted under 35 U.S.C. 154(b) by 0 days.

(21) Appl. No.: 16/500,632

(22) PCT Filed: Apr. 3, 2018

(86) PCT No.: PCT/EP2018/058398
§ 371 (c)(1),
(2) Date: Oct. 3, 2019

(87) PCT Pub. No.: WO2018/188982
PCT Pub. Date: Oct. 18, 2018

(65) Prior Publication Data

US 2020/0102515 A1 Apr. 2, 2020

(30) Foreign Application Priority Data

Apr. 11, 2017 (EP) ..... 17165955

(51) Int. Cl.
*C10L 1/222* (2006.01)
*C10L 1/2383* (2006.01)
*C10L 10/04* (2006.01)

(52) U.S. Cl.
CPC ..... *C10L 1/2222* (2013.01); *C10L 1/2383* (2013.01); *C10L 10/04* (2013.01); *C10L 2200/0423* (2013.01); *C10L 2270/023* (2013.01)

(58) Field of Classification Search
CPC ..... C10L 10/04; C10L 1/2222; C10L 1/2383; C10L 2200/0423; C10L 2270/023
See application file for complete search history.

(56) References Cited

U.S. PATENT DOCUMENTS 4,129,508 A * 12/1978 Friihauf ..... C10L 1/143 508/399
4,409,000 A * 10/1983 LeSuer ..... C10L 1/143 44/331
4,849,572 A 7/1989 Chen et al.
4,877,416 A 10/1989 Campbell
2006/0196110 A1* 9/2006 Schwahn ..... C10L 10/08 44/413
2010/0107484 A1 5/2010 Vilardo

FOREIGN PATENT DOCUMENTS

| | | | |
|---|---|---|---|
| DE | 38 26 608 | A1 | 2/1990 |
| DE | 38 38 918 | A1 | 5/1990 |
| DE | 41 42 241 | A1 | 6/1993 |
| DE | 43 09 074 | A1 | 9/1994 |
| DE | 196 20 262 | A1 | 11/1997 |
| DE | 101 02 913 | A1 | 7/2002 |
| DE | 103 16 871 | A1 | 10/2004 |
| EP | 0 307 815 | A1 | 3/1989 |
| EP | 0 310 875 | A1 | 4/1989 |
| EP | 0 356 725 | A1 | 3/1990 |
| EP | 0 452 328 | A1 | 10/1991 |
| EP | 0 476 485 | A1 | 3/1992 |
| EP | 0 548 617 | A2 | 6/1993 |
| EP | 0 639 632 | A1 | 2/1995 |
| EP | 0 700 985 | A1 | 3/1996 |
| EP | 0 831 141 | A1 | 3/1998 |
| EP | 0 905 217 | A1 | 3/1999 |
| WO | WO 87/01126 | A1 | 2/1987 |
| WO | WO 91/03529 | A1 | 3/1991 |
| WO | WO 94/24231 | A1 | 10/1994 |
| WO | WO 96/03367 | A1 | 2/1996 |
| WO | WO 96/03479 | A1 | 2/1996 |
| WO | WO 97/03946 | A1 | 2/1997 |
| WO | WO 03/027211 | A1 | 4/2003 |
| WO | WO 2008/115939 | A1 | 9/2008 |
| WO | WO 2011/076949 | A1 | 6/2011 |
| WO | WO 2014/023853 | A2 | 2/2014 |
| WO | WO 2015/114029 | A1 | 8/2015 |

OTHER PUBLICATIONS

Extended European Search Report dated Jun. 2, 2017 in Patent Application No. 17165955.0, 4 pages (with English translation of categories of cited documents).
International Search Report dated Jun. 25, 2018 in PCT/EP2018/058398, 7 pages (with English translation).
Arters, D.C. et al. "The Effect on Vehicle Performance of Injector Deposits in a Direct Injection Gasoline Engine" SAE Technical Paper Series, vol. 1, XP055375064, 2000, 12 Pages.

* cited by examiner

*Primary Examiner* — Latosha Hines
(74) *Attorney, Agent, or Firm* — Grüneberg and Myers PLLC

(57) ABSTRACT

The present invention describes alkoxylated amines as fuel additives for reducing injector deposits in direct injection gasoline engines.

20 Claims, No Drawings

ALKOXYLATED AMINES AS FUEL ADDITIVES

The present invention describes alkoxylated amines as fuel additives for reducing injector deposits in direct injection gasoline engines.

EP 700985 A1 discloses using butoxylated polyetheramines of mono- or polyamines as additives in fuels for gasoline engines. The polyetheramines show a reduction in deposits at the intake valves. Polyetheramines are prepared by butoxylation of alkanols followed by reductive amination of the products obtained with mono- or polyamines. The polyetheramines therefore do not bear any free hydroxyl groups, but rather alkyl-capped butylene oxide chains.

WO 2011/076949 discloses the use of mixedly ethoxylated/propoxylated polyetheramines of monoamines in alcohol-containing gasoline fuels for improving fuel consumption and/or reducing deposits at intake valves and/or injection nozzle.

DE 10316871 A1 and EP 310875 A1 disclose using polyetheramines such as tridecanol or isotridecanol propoxylate and/or butoxylate ammonia reaction products in fuels.

It was an object of the present invention to provide compounds with which the formation of deposits at injection nozzles can be avoided or reduced and/or existing deposits can be removed in direct injection gasoline engines.

The object was achieved by the use of compounds (A) selected from the group consisting of formula (I)

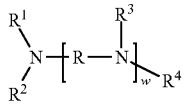

and formula (II)

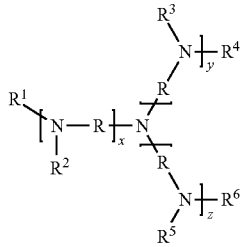

in which

R is a divalent organic radical, preferably an alkylene radical having 2 to 10 carbon atoms, $R^1$, $R^2$, $R^3$, $R^4$, $R^5$ and $R^6$ are independently hydrogen or a monovalent organic radical or a $—[—X_i—]_n—H$ radical or $R^1$ and $R^2$ collectively and together with the nitrogen atom may form a five- to seven-membered ring, preferably hydrogen, an alkyl radical having 1 to 20 carbon atoms or a $—[—X_i—]_n—H$ radical, w is a positive integer and x, y and z are independently zero or a positive integer, in which n is a positive integer, and in which each $X_i$ for i=1 to n is independently selected from the group consisting of $—CH_2—CH_2—O—$, $—CH_2—CH(CH_3)—O—$, $—CH(CH_3)—CH_2—O—$, $—CH_2—C(CH_3)_2—O—$, $—C(CH_3)_2—CH_2—O—$, $—CH_2—CH(C_2H_5)—O—$, $—CH(C_2H_5)—CH_2—O—$ and $—CH(CH_3)—CH(CH_3)—O—$, preferably selected from the group consisting of $—CH_2—CH(CH_3)—O—$, $—CH(CH_3)—CH_2—O—$, $—CH_2—C(CH_3)_2—O—$, $—C(CH_3)_2—CH_2—O—$, $—CH_2—CH(C_2H_5)—O—$ and $—CH(C_2H_5)—CH_2—O—$ and $—CH(CH_3)—CH(CH_3)—O—$, more preferably selected from the group consisting of $—CH_2—CH(CH_3)—O—$, $—CH(CH_3)—CH_2—O—$, $—CH_2—C(CH_3)_2—O—$, $—C(CH_3)_2—CH_2—O—$, $—CH_2—CH(C_2H_5)—O—$ and $—CH(C_2H_5)—CH_2—O—$, most preferably selected from the group consisting of $—CH_2—CH(C_2H_5)—O—$, $—CH(C_2H_5)—CH_2—O—$, $—CH_2—CH(CH_3)—O—$ and $—CH(CH_3)—CH_2—O—$, and especially selected from the group consisting of $—CH_2—CH(CH_3)—O—$ and $—CH(CH_3)—CH_2—O—$, with the proviso that the sum total of x, y and z is non-zero, at least one of the $R^1$, $R^2$, $R^3$, $R^4$, $R^5$ and $R^6$ radicals is not hydrogen and at least one of the $R^1$, $R^2$, $R^3$, $R^4$, $R^5$ and $R^6$ radicals represents a $—[—X_i]_n—H$ radical, in gasoline fuels for avoidance and/or reduction of the formation of deposits at injection nozzles in direct injection gasoline engines and/or removing and/or reducing existing deposits at injection nozzles in direct injection gasoline engines.

Among these, preference is given to the compounds of the formula (I).

In a preferred embodiment, the compounds of the formula (III) satisfy

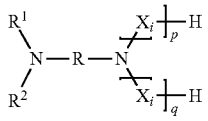

in which $R^1$, $R^2$ and $X_i$ have the definitions given above and p and q are independently a positive integer.

In this formula, $R^1$, $R^2$, $R^3$, $R^4$, $R^5$ and $R^6$ are independently hydrogen or a monovalent organic radical or $R^1$ and $R^2$ may collectively and together with the nitrogen atom form a five- to seven-membered ring.

Preferred monovalent organic radicals are $C_1$- to $C_{20}$-alkyl, $C_5$- to $C_{12}$-cycloalkyl, $C_6$- to $C_{12}$-aryl or a $—[—X_i—]_n—H$ radical, more preferably $C_1$- to $C_{10}$-alkyl, $C_5$- to $C_6$-cycloalkyl, $C_6$- to $C_{12}$-aryl or a $—[—X_i—]_n—H$ radical, most preferably more preferably $C_1$- to $C_4$-alkyl, especially methyl.

Preferably, $R^1$ and $R^2$ are both the same and each is $C_1$- to $C_4$-alkyl and more preferably methyl.

In addition, it is possible that $R^1$ and $R^2$ collectively and together with the nitrogen atom form a five- to seven-membered ring, particularly a five- or six-membered ring and more preferably a six-membered ring.

This is subject to the proviso that at least one of the $R^1$, $R^2$, $R^3$, $R^4$, $R^5$ and $R^6$ radicals is not hydrogen and at least one of the $R^1$, $R^2$, $R^3$, $R^4$, $R^5$ and $R^6$ radicals represents a $[—X_i—]_n—H$ radical; preferably, at least two of the $R^1$, $R^2$, $R^3$, $R^4$, $R^5$ and $R^6$ radicals are a $[—X_i—]_n—H$ radical.

R is a divalent organic radical, preferably an alkylene radical having 2 to 10 carbon atoms, preferably an alkylene radical having 2 to 6 carbon atoms, more preferably an alkylene radical having 2 to 4 carbon atoms, even more preferably an alkylene radical having 2 or 3 carbon atoms and especially an alkylene radical having 3 carbon atoms.

Preferably, R is 1,2-ethylene, 1,2-propylene, 1,3-propylene, 1,2-butylene, 1,3-butylene, 1,4-butylene, 1,5-pentylene, 1,6-hexylene, 1,8-octylene and 1,10-decylene, more preferably 1,2-ethylene, 1,2-propylene, 1,3-propylene, 1,2-butylene, 1,4-butylene or 1,6-hexylene, most preferably 1,2-ethylene, 1,2-propylene or 1,3-propylene, and for compounds of the formula (I) or (III) especially 1,3-propylene, and for compounds of the formula (II) especially 1,2-ethylene or 1,3-propylene, specifically 1,2-ethylene.

In addition, w is a positive integer, preferably 1, 2, 3 or 4, more preferably 1, 2 or 3, even more preferably 1 or 2 and especially 1.

In addition, x, y and z are independently positive integers, preferably 1, 2, 3 or 4, more preferably 1, 2 or 3, even more preferably 1 or 2 and especially 1.

This is subject to the proviso that the sum total of x, y and z is non-zero; preferably, the sum total of x, y and z is at least 2, more preferably at least 3.

Preferably, the sum total of x, y and z is not greater than 10, more preferably not greater than 8, even more preferably not greater than 6 and especially not greater than 5.

In addition, each $X_i$ for i=1 to n is independently selected from the group consisting of —$CH_2$—$CH_2$—O—, —$CH_2$—$CH(CH_3)$—O—, —$CH_2(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O— and —$CH(CH_3)$—$CH(CH_3)$—O—, preferably selected from the group consisting of —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O— and —$CH(CH_3)$—$CH(CH_3)$ O—, more preferably selected from the group consisting of —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O— and —$CH(C_2H_5)$—$CH_2$—O— and most preferably selected from the group consisting of —$CH_2$—$CH(C_2H_5)$—O—, —$CH(C_2H_5)$—$CH_2$—O—, —$CH_2$—$CH(CH_3)$—O— and —$CH(CH_3)$—$CH_2$—O—, and especially selected from the group consisting of —$CH_2$—$CH(CH_3)$—O— and —$CH(CH_3)$—$CH_2$—O—.

It should be noted here that, in any —[—$X_i$—]$_n$— chain that occurs in the compounds, the units may be distributed statistically, and so both the length of the chains and the distribution of the $X_i$ units within the chains may be different.

In addition, n, p and q are independently a positive integer from 1 to 50, preferably from 1 to 25, more preferably from 2 to 20 and most preferably from 5 to 15.

The sum total of p and q is preferably from 2 to 50, more preferably from 5 to 40, even more preferably from 10 to 30 and especially from 12 to 27.

Examples of $C_1$- to $C_{20}$-alkyl are methyl, ethyl, isopropyl, n-propyl, n-butyl, iso-butyl, sec-butyl, tert-butyl, n-hexyl, n-heptyl, n-octyl, 2-ethylhexyl, n-decyl, 2-propylheptyl, n-dodecyl, n-tetradecyl, n-hexadecyl, n-octadecyl and n-eicosyl.

Examples of $C_1$- to $C_{10}$-alkyl are methyl, ethyl, isopropyl, n-propyl, n-butyl, iso-butyl, sec-butyl, tert-butyl, n-hexyl, n-heptyl, n-octyl, 2-ethylhexyl, n-decyl and 2-propylheptyl.

Examples of $C_1$- to $C_4$-alkyl are methyl, ethyl, iso-propyl, n-propyl, n-butyl, iso-butyl, sec-butyl and tert-butyl, preferably methyl, ethyl and n-butyl, more preferably methyl and ethyl and most preferably methyl.

Examples $C_5$- to $C_{12}$-cycloalkyl are cyclopentyl, cyclohexyl, cycloheptyl, cyclooctyl, cyclodecyl and cyclododecyl, preferably cyclopentyl and cyclohexyl.

Examples of $C_6$- to $C_{12}$-aryl phenyl, tolyl, ethylphenyl, benzyl, phenethyl, xylyl and naphthyl.

The following compounds of the formula (I) are preferred embodiments:

(Ia) R is 1,2-ethylene, w=1, $R^1$ to $R^3$ are methyl and $R^4$ is a [—$X_i$—]$_n$—H chain.

(Ib) R is 1,2-ethylene, w=1, $R^1$ and $R^2$ are methyl and $R^3$ and $R^4$ are each independently a [—$X_i$—]$_n$—H chain.

(Ic) R is 1,2-propylene, w=1, $R^1$ and $R^2$ are methyl and $R^3$ and $R^4$ are each independently a —[—$X_i$—]$_n$—H chain.

(Id) R is 1,3-propylene, w=1, $R^1$ and $R^2$ are methyl and $R^3$ and $R^4$ are each independently a —[—$X_i$—]$_n$—H chain.

(Ie) R is 1,3-propylene, w=1, $R^1$ and $R^2$ are ethyl and $R^3$ and $R^4$ are each independently a —[—$X_i$—]$_n$—H chain.

(If) R is 1,3-propylene, w=1, $R^1$ and $R^2$ are n-butyl and $R^3$ and $R^4$ are each independently a —[—$X_i$—]$_n$—H chain.

(Ig) R is 1,2-ethylene, w=1, $R^1$ to $R^4$ are a —[—$X_i$—]$_n$—H chain.

Among these, particular preference is given to compounds (Id).

The following compounds of the formula (II) are preferred:

(IIa) R is 1,2-ethylene, x and y are 1, z=0 and $R^1$ to $R^4$ and $R^6$ are each independently a —[—$X_i$—]$_n$—H chain.

(IIb) R is 1,2-propylene, x and y are 1, z=0 and $R^1$ to $R^4$ and $R^6$ are each independently a —[—$X_i$—]$_n$—H chain.

(IIc) R is 1,3-propylene, x and y are 1, z=0 and $R^1$ to $R^4$ are each independently a —[—$X_i$—]$_n$—H chain, and $R^6$ is $C_1$- to $C_{20}$-alkyl.

Among these, particular preference is given to compounds (IIa).

The following compounds of the formula (III) are preferred:

(IIIa) R is 1,2-ethylene and $R^1$ and $R^2$ are methyl (IIIb) R is 1,2-ethylene and $R^1$ and $R^2$ are ethyl (IIIc) R is 1,2-ethylene and $R^1$ and $R^2$ are n-butyl (IIId) R is 1,2-ethylene and $R^1$ and $R^2$ are collectively a 1,4-butylene chain (IIIe) R is 1,2-ethylene and $R^1$ and $R^2$ are collectively a 1,5-pentylene chain (IIIf) R is 1,2-ethylene and $R^1$ and $R^2$ are collectively a 3-oxa-1,5-pentylene chain (IIIg) R is 1,2-propylene and $R^1$ and $R^2$ are methyl (IIIh) R is 1,2-propylene and $R^1$ and $R^2$ are ethyl (Illi) R is 1,2-propylene and $R^1$ and $R^2$ are n-butyl (IIIj) R is 1,2-propylene and $R^1$ and $R^2$ are collectively a 1,4-butylene chain (IIIk) R is 1,2-propylene and $R^1$ and $R^2$ are collectively a 1,5-pentylene chain (IIIl) R is 1,2-propylene and $R^1$ and $R^2$ are collectively a 3-oxa-1,5-pentylene chain (IIIm) R is 1,3-propylene and $R^1$ and $R^2$ are methyl (IIIn) R is 1,3-propylene and $R^1$ and $R^2$ are ethyl (IIIo) R is 1,3-propylene and $R^1$ and $R^2$ are n-butyl (IIIp) R is 1,3-propylene and $R^1$ and $R^2$ are collectively a 1,4-butylene chain (IIIq) R is 1,3-propylene and $R^1$ and $R^2$ are collectively a 1,5-pentylene chain (IIIr) R is 1,3-propylene and $R^1$ and $R^2$ are collectively a 3-oxa-1,5-pentylene chain.

Among these, particular preference is given to compounds (IIIg).

Particular preference is given to the reaction products of ethylene-1,2-diamine, diethylenetriamine, triethylenetetramine or 3-(dimethylamino)propylamine, preferably diethylenetriamine or 3-(dimethylamino)propylamine and more preferably 3-(dimethylamino)propylamine with 10 to 30, preferably 12 to 27 and more preferably 15 to 25 equivalents of propylene oxide and/or 1,2-butylene oxide.

The compounds described are used in accordance with the invention, in the operation of direct injection gasoline engines with gasoline fuels, to prevent or to reduce the formation of deposits at direct injection nozzles and/or to remove or to reduce existing deposits.

It is an advantage of the compounds described that these can act as carrier oil alternatively or additionally to this described use, and so the amount of carrier oil in the additive packages (see below) can be reduced.

It is a further advantage of the compounds described that these can act as a demulsifier alternatively or additionally to these described uses.

The present invention further provides fuel additive concentrates comprising (A) at least one compound of the formula (I), (II) or (III), preferably (I) or (III) and more preferably (III), and (B) at least one further additive component.

The preparation of alkoxylated amines (amines having primary and/or secondary amino groups) is known in principle; for example, it is described in H. L. Sanders et al., Journal of the American Oil Chemists Society, 1969, 46, 167-170 and in WO 2013/076024.

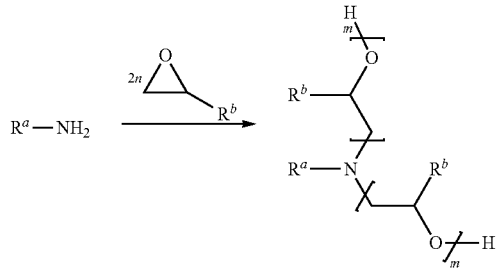

Typically, the alkoxylation of amines and polyamines is effected in two stages: firstly, a sufficient amount of alkylene oxide is used to achieve an average alkoxylation level of 0.5 to 1.5, preferably of 0.75 to 1.25, mol of alkylene oxide per NH function. This step is typically conducted in the presence of water (preferably 0.5-10.0% by weight based on the amine used), but can also be effected in the absence of water. The conversion is typically effected at a temperature of 50° C. to 180° C., preferably 90° C. to 160° C. The alkylene oxide is preferably metered in within a period of 1 to 10 h.

The further construction of polyalkylene oxide chains is effected under base catalysis after removal of the solvent, especially water. Examples of basic catalysts used include: potassium hydroxide, sodium hydroxide, potassium methoxide or sodium methoxide, preferably potassium hydroxide or sodium hydroxide.

The alkoxylated amines can alternatively be formed in one stage, in which case possible catalysts used may be potassium hydroxide, sodium hydroxide, potassium methoxide, sodium methoxide, potassium acetate or sodium acetate.

The reaction can in principle alternatively be effected without catalyst since the amine used can itself catalyze the alkoxylation (see Mihail Ionescu, Chemistry and Technology of Polyols for Polyurethanes, Rapra Technology Limited, 2005).

The alkylene oxides comprise generally 2 or more carbon atoms, preferably 2 to 20 carbon atoms, especially from 2 to 12 carbon atoms. Possible alkylene oxides are ethylene oxide, propylene oxide, isobutylene oxide, 1,2-butylene oxide, 2,3-butylene oxide, 1,2-pentene oxide, 1,2-dodecene oxide, styrene oxide. Possible alkylene oxides also include glycidyl ethers, for example 2-ethylhexyl glycidyl ether. Particular preference is given to propylene oxide and 1,2-butylene oxide.

If a metal-containing catalyst has been used, the metal is advantageously removed from the product for use in fuels or lubricants. These methods are known in principle and are described in Mihail Ionescu, Chemistry and Technology of Polyols for Polyurethanes, Rapra Technology Limited, 2005. For instance, alkali metals or alkaline earth metals can be removed by adsorption on magnesium silicates (commercial products: Ambosol® or Magnesol®). Potassium ions can be removed by precipitation with phosphoric acid as potassium hydrogenphosphate and subsequent filtration. Alkali metals or alkaline earth metals can also be removed with the aid of regeneratable ion exchangers, and the alkoxylated amine can also be dissolved in a solvent.

B) Further Additive Components

The compounds (A) of the invention can be added to the fuels to be additized individually or in a mixture with further active additive components (coadditives).

B1) Detergent Additives

Examples include additives having detergent action and/or having valve seat wear-inhibiting action (referred to hereinafter as detergent additives). This detergent additive has at least one hydrophobic hydrocarbon radical having a number-average molecular weight (Mn) of 85 to 20 000 and at least one polar moiety which is selected from:

(a) mono- or polyamino groups having up to 6 nitrogen atoms, where at least one nitrogen atom has basic properties;

(b) nitro groups, optionally in combination with hydroxyl groups;

(c) hydroxyl groups in combination with mono- or polyamino groups, where at least one nitrogen atom has basic properties;

(d) carboxyl groups or the alkali metal or alkaline earth metal salts thereof;

(e) sulfonic acid groups or the alkali metal or alkaline earth metal salts thereof;

(f) polyoxy-$C_2$- to $C_4$-alkylene moieties terminated by hydroxyl groups, mono- or polyamino groups, at least one nitrogen atom having basic properties, or by carbamate groups;

(g) carboxylic ester groups;

(h) moieties derived from succinic anhydride and having hydroxyl and/or amino and/or amido and/or imido groups; and/or (i) moieties obtained by Mannich reaction of substituted phenols with aldehydes and mono- or polyamines.

The hydrophobic hydrocarbon radical in the above detergent additives which ensures sufficient solubility in the fuel has a number-average molecular weight (Mn) of 85 to 20 000, especially of 113 to 10 000 and particularly of 300 to 5000. Useful typical hydrophobic hydrocarbon radicals, especially in conjunction with the polar moieties (a), (c), (h) and (i), include the polypropenyl, polybutenyl and polyisobutenyl radicals each having Mn=300 to 5000, especially 500 to 2500 and particularly 700 to 2300.

Examples of the above groups of detergent additives include the following:

Additives comprising mono- or polyamino groups (a) are preferably polyalkenemono- or polyalkenepolyamines based on polypropene or conventional (i.e. with predominantly internal double bonds) polybutene or polyisobutene with Mn=300 to 5000. When polybutene or polyisobutene having predominantly internal double bonds (usually in the beta and gamma positions) are used as starting materials in the preparation of the additives, a possible preparative route is by chlorination and subsequent amination or by oxidation of the double bond with air or ozone to give the carbonyl or carboxyl compound and subsequent amination under reductive (hydrogenating) conditions. Amination can be accomplished here using amines, for example ammonia, monoamines or polyamines such as dimethylaminopropylamine, ethylenediamine, diethylenetriamine, triethylenetetramine or tetraethylenepentamine. Corresponding additives based on polypropene are described more particularly in WO-A-94/24231.

Further preferred additives comprising monoamino groups (a) are the hydrogenation products of the reaction products of polyisobutenes having an average degree of polymerization P=5 to 100 with nitrogen oxides or mixtures of nitrogen oxides and oxygen, as described more particularly in WO-A-97/03946.

Further preferred additives comprising monoamino groups (a) are the compounds obtainable from polyisobutene epoxides by reaction with amines and subsequent dehydration and reduction of the amino alcohols, as described more particularly in DE-A-196 20 262.

Additives comprising nitro groups (b), optionally in combination with hydroxyl groups, are preferably reaction products of polyisobutenes having an average degree of polymerization P=5 to 100 or 10 to 100 with nitrogen oxides or mixtures of nitrogen oxides and oxygen, as described more particularly in WO-A-96/03367 and in WO-A-96/03479. These reaction products are generally mixtures of pure nitropolyisobutenes (e.g. alpha,beta-dinitropolyisobutene) and mixed hydroxynitropolyisobutenes (e.g. alpha-nitro-beta-hydroxypolyisobutene).

Additives comprising hydroxyl groups in combination with mono- or polyamino groups (c) are in particular reaction products of polyisobutene epoxides obtainable from polyisobutene having preferably predominantly terminal double bonds and Mn=from 300 to 5000, with ammonia or mono- or polyamines, as described in particular in EP-A-476 485.

Additives comprising carboxyl groups or their alkali metal or alkaline earth metal salts (d) are preferably copolymers of $C_2$-$C_{40}$-olefins with maleic anhydride which have a total molar mass of 500 to 20 000 and wherein some or all of the carboxyl groups have been converted to the alkali metal or alkaline earth metal salts and any remainder of the carboxyl groups has been reacted with alcohols or amines. Such additives are disclosed more particularly by EP-A-307 815. Such additives serve mainly to prevent valve seat wear and can, as described in WO-A-87/01126, advantageously be used in combination with customary fuel detergents such as poly(iso)buteneamines or polyetheramines.

Additives comprising sulfonic acid groups or their alkali metal or alkaline earth metal salts (e) are preferably alkali metal or alkaline earth metal salts of an alkyl sulfosuccinate, as described more particularly in EP-A-639 632. Such additives serve mainly to prevent valve seat wear and can be used advantageously in combination with customary fuel detergents such as poly(iso)buteneamines or polyetheramines.

Additives comprising polyoxy-$C_2$-$C_4$-alkylene moieties (f) are preferably polyethers or polyetheramines which are obtainable by reaction of $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with 1 to 30 mol of ethylene oxide and/or propylene oxide and/or butylene oxide per hydroxyl group or amino group and, in the case of the polyetheramines, by subsequent reductive amination with ammonia, monoamines or polyamines. Products of this kind are especially described in EP-A-310 875, EP-A-356 725, EP-A-700 985 and U.S. Pat. No. 4,877,416. In the case of polyethers, such products also satisfy carrier oil properties. Typical examples thereof are tridecanol butoxylates or isotridecanol butoxylates, isononylphenol butoxylates and also polyisobutenol butoxylates and propoxylates, and also the corresponding reaction products with ammonia.

Additives comprising carboxylic ester groups (g) are preferably esters of mono-, di- or tricarboxylic acids with long-chain alkanols or polyols, especially those having a minimum viscosity of 2 $mm^2/s$ at 100° C., as described more particularly in DE-A-38 38 918. The mono-, di- or tricarboxylic acids used may be aliphatic or aromatic acids; particularly suitable ester alcohols or ester polyols are long-chain representatives having, for example, 6 to 24 carbon atoms. Typical representatives of the esters are adipates, phthalates, isophthalates, terephthalates and trimellitates of isooctanol, of isononanol, of isodecanol and of isotridecanol. Such products also satisfy carrier oil properties.

Additives comprising moieties that are derived from succinic anhydride and have hydroxyl and/or amino and/or amido and/or imido groups (h) are preferably corresponding derivatives of polyisobutenylsuccinic anhydride obtainable by reaction of conventional or high-reactivity polyisobutene with Mn=300 to 5000 with maleic anhydride by a thermal route or via the chlorinated polyisobutene. Of particular interest here are derivatives with aliphatic polyamines such as ethylenediamine, diethylenetriamine, triethylenetetramine or tetraethylenepentamine. Such gasoline fuel additives are more particularly described in U.S. Pat. No. 4,849,572.

Additives comprising moieties (i) obtained by Mannich reaction of substituted phenols with aldehydes and mono- or polyamines are preferably reaction products of polyisobutene-substituted phenols with formaldehyde and mono- or polyamines such as ethylenediamine, diethylenetriamine, triethylenetetramine, tetraethylenepentamine or dimethylaminopropylamine.

The polyisobutenyl-substituted phenols may originate from conventional or high-reactivity polyisobutene having Mn=300 to 5000. Such "polyisobutene Mannich bases" are more particularly described in EP-A-831 141.

For a more precise definition of the gasoline fuel additives detailed individually, reference is explicitly made here to the disclosures of the abovementioned prior art documents.

B2) Carrier Oils and Further Components:

The additive formulations of the invention can additionally be combined with further customary components and additives. These primarily include carrier oils without marked detergent action. Suitable mineral carrier oils are fractions obtained in crude oil processing, such as bright-stock or base oils having viscosities, for example, from the SN 500-2000 class; but also aromatic hydrocarbons, paraffinic hydrocarbons and alkoxyalkanols. Likewise useful is a fraction which is obtained in the refining of mineral oil and is known as "hydrocrack oil" (vacuum distillate cut having a boiling range of from about 360 to 500° C., obtainable from natural mineral oil which has been catalytically hydrogenated under high pressure and isomerized and also deparaffinized). Likewise suitable are mixtures of the abovementioned mineral carrier oils.

Examples of synthetic carrier oils usable in accordance with the invention are selected from: polyolefins (polyalphaolefins or polyinternalolefins), (poly)esters, (poly)alkoxylates, polyethers, aliphatic polyetheramines, alkylphenol-started polyethers, alkylphenol-started polyetheramines and carboxylic esters of long-chain alkanols.

Examples of particularly suitable synthetic carrier oils are alcohol-started polyethers having about 5 to 35 $C_3$- to $C_6$-alkylene oxide units, usually selected from propylene oxide, n-butylene oxide and isobutylene oxide units or mixtures thereof. Nonlimiting examples of starter alcohols suitable for the purpose are long-chain alkanols or phenols substituted by long-chain alkyl where the long-chain alkyl radical is especially a straight-chain or branched $C_6$- to $C_{13}$-alkyl radical. Preferred examples of these include tridecanol, heptadecanol and nonylphenol.

Through the use of the inventive compounds (A), it is often possible to reduce the use of carrier oils.

Examples of suitable polyolefins are olefin polymers having Mn=400 to 1800, in particular based on polybutene or polyisobutene (hydrogenated or unhydrogenated).

Examples of suitable polyethers or polyetheramines are preferably compounds comprising polyoxy-$C_2$-$C_4$-alkylene moieties obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with 1 to 30 mol of ethylene oxide and/or propylene oxide and/or butylene oxide per hydroxyl group or amino group, and, in the case of the polyetheramines, by subsequent reductive amination with ammonia, monoamines or polyamines. Products of this kind are especially described in EPA-310 875, EP-A-356 725, EP-A-700 985 and U.S. Pat. No. 4,877,416. For example, the polyetheramines used may be poly-$C_2$-$C_6$-alkylene oxide amines or functional derivatives thereof. Typical examples thereof are tridecanol butoxylates or isotridecanol butoxylates, heptadecanol or isoheptadecanol butoxylates, isononylphenol butoxylates and also polyisobutenol butoxylates and propoxylates, and also the corresponding reaction products with ammonia.

Examples of carboxylic esters of long-chain alkanols are more particularly esters of mono-, di- or tricarboxylic acids with long-chain alkanols or polyols, as described more particularly in DE-A-38 38 918. The mono-, di- or tricarboxylic acids used may be aliphatic or aromatic acids; particularly suitable ester alcohols or ester polyols are long-chain representatives having, for example, 6 to 24 carbon atoms. Typical representatives of the esters are adipates, phthalates, isophthalates, terephthalates and trimellitates of isooctanol, of isononanol, of isodecanol and of isotridecanol, for example di(n- or isotridecyl) phthalate or di(isoheptadecyl) phthalate.

Further suitable carrier oil systems are described, for example, in DE-A-38 26 608, DE-A-41 42 241, DE-A-43 09 074, EP-A-0 452 328 and EP-A-0 548 617, which are hereby explicitly incorporated by reference.

Examples of particularly suitable synthetic carrier oils are alcohol-started polyethers having about 5 to 35, preferably about 5 to 30 and more preferably 7 to 25 $C_3$-$C_6$-alkylene oxide units, for example selected from propylene oxide, n-butylene oxide and i-butylene oxide units, or mixtures thereof, preferably selected from propylene oxide and i-butylene oxide units. Nonlimiting examples of suitable starter alcohols are long-chain alkanols or phenols substituted by long-chain alkyl in which the long-chain alkyl radical is especially a straight-chain or branched $C_6$-$C_{13}$-alkyl radical. Preferred examples of alkanols include decanol, tridecanol, heptadecanol and nonylphenol, more preferably branched decanol, tridecanol and heptadecanol.

Further suitable synthetic carrier oils are alkoxylated alkylphenols, as described in DE-A-10 102 913.

B3) Further Coadditives

Further customary additives are corrosion inhibitors, for example based on ammonium salts that have a tendency to film formation, these being salts of organic carboxylic acids or of heterocyclic aromatics in the case of nonferrous metal corrosion protection; preferred corrosion inhibitors are mono-, di- and polycarboxylic acids which have at least 12 carbon atoms, preferably at least 14, more preferably at least 16 and most preferably at least 18 carbon atoms, and preferably do not have any further functionalities aside from hydrocarbyl radicals and carboxyl groups. Examples of these are fatty acids, dimer fatty acids, alkyl- and alkenylsuccinic acids, and hydrolyzed olefin-maleic anhydride copolymers, preference being given to dodecanoic acid (lauric acid), tridecanoic acid, tetradecanoic acid (myristic acid), pentadecanoic acid, palmitic acid (hexadecanoic acid), margaric acid (heptadecanoic acid), stearic acid (octadecanoic acid), nonadecanoic acid, arachic acid (eicosanoic acid), behenic acid (docosanoic acid), tetracosanoic acid (lignoceric acid), cerotic acid (hexacosanoic acid), triacontanoic acid (melissic acid), palmitoleic acid [(9Z)-hexadec-9-enoic acid], oleic acid [(9Z)-octadec-9-enoic acid], elaidic acid [(9E)-octadec-9-enoic acid], erucic acid [(13Z)-docos-13-enoic acid], linoleic acid [(9Z,12Z)-octadeca-9,12-dienoic acid], linolenic acid [(9Z,12Z,15Z)-octadeca-9,12,15-trienoic acid] and eleostearic acid [(9Z,11E,13E)-octadeca-9,11,13-trienoic acid], dimeric oleic acid (CAS: 61788-89-4), dodecenylsuccinic acid, dodecylsuccinic acid, hexadecenylsuccinic acid, hexadecylsuccinic acid, polyisobutenylsuccinic acid and derivatives thereof in which the polyisobutene radical has a molecular weight of 250 to 2300, preferably of 350 to 2000, more preferably of 500 to 1500 and most preferably of 700 to 1100, and hydrolyzed copolymers of α-olefins having 12 to 30 carbon atoms and maleic anhydride, as described, for example, in WO 2015/114029.

Mention should also be made of antioxidants or stabilizers, for example based on amines such as p-phenylenediamine, dicyclohexylamine or derivatives thereof or of phenols such as 2,4-di-tert-butylphenol or 3,5-di-tert-butyl-4-hydroxyphenylpropionic acid; demulsifiers; antistats; metallocenes such as ferrocene; methylcyclopentadienylmanganese tricarbonyl; lubricity improvers (other than the triazoles of the invention) such as particular fatty acids, alkenylsuccinic esters, bis(hydroxyalkyl) fatty amines, hydroxyacetamides or castor oil; and dyes (markers). It is optionally also possible to add amines to lower the pH of the fuel.

Examples of solvents are, for example, aromatics such as solvent naphtha, preferably naphthalene-depleted solvent naphtha, benzene, toluene, xylene, kerosene having an aromatics content below 50% by volume, a sulfur content below 10 mg/kg and a flashpoint to DIN EN ISO 13736: 2000-04 above 60° C., and higher alcohols having a flashpoint to DIN EN ISO 13736: 2000-04 above 60° C., preferably 2-ethylhexanol or 2-propylheptanol.

The components or additives can be added to the fuel individually or as a previously prepared concentrate (additive package) together with the inventive compound (A).

The detergent additives (81) mentioned with the polar moieties (a) to (i) are added to the fuel typically in an amount of 10 to 5000 ppm by weight, especially 50 to 1000 ppm by weight. The other components and additives mentioned are, if desired, added in amounts customary for the purpose.

A preferred embodiment is that of fuel additive concentrates comprising (A) at least one compound of the formula (I), (II) or (III), (B1) at least one compound having detergent action, preferably at least one compound (B1a), more preferably at least one compound (B1a) which is a polyisobuteneamine obtainable by hydroformylation and subsequent reductive amination, most preferably with ammonia, of polyisobutene with Mn=300 to 5000, (B2) at least one carrier oil, and (B3) at least one corrosion inhibitor.

More preferably, the fuel additive concentrates are of the following composition:

(A) 1-50% by weight, preferably 2-40% by weight, more preferably 5-30% by weight, (B1) 20-96.75% by weight, preferably 40-94.5% by weight, more preferably 60-89% by weight, (B2) 2-30% by weight, preferably 3-25% by weight, more preferably 5-20% by weight, and (B3) 0.25-10% by weight, preferably 0.5-7.5% by weight, more preferably 1-5% by weight, and optionally further coadditives, with the proviso that the sum total of all components always adds up to 100% by weight.

C) Fuels

The additive compositions of the invention are usable in all conventional gasoline fuels as described, for example, in Ullmann's Encyclopedia of Industrial Chemistry, 5th ed. 1990, volume A16, p. 719 ff.

Therefore, the present invention further provides fuel compositions comprising (A) at least one compound of the formula (I), (II) or (III), preferably (I) or (III) and more preferably (B) at least one further additive component, and (C) at least one fuel, preferably at least one gasoline fuel, more preferably at least one gasoline fuel to DIN EN 228.

One example is use in a gasoline fuel having an aromatics content of not more than 60% by volume, for example not more than 42% or not more than 35% by volume, and/or a sulfur content of not more than 2000 ppm by weight, for example not more than 150 or not more than 10 ppm by weight.

The aromatics content of the gasoline fuel is, for example, 10% to 50% by volume, for example 30% to 42% by volume, especially 32% to 40% by volume, or not more than 35% by volume. The sulfur content of the gasoline fuel is, for example, 2 to 500 ppm by weight, for example 5 to 100 ppm by weight, or not more than 10 ppm by weight.

In addition, the gasoline fuel may have, for example, an olefin content of up to 50% by volume, for example of 6% to 21% by volume, especially 7% to 18% by volume; a benzene content of up to 5% by volume, for example 0.5% to 1.0% by volume, especially 0.6% to 0.9% by volume, and/or an oxygen content of up to 25% by volume, for example up to 10% by weight or 1.0% to 2.7% by weight, especially of 1.2% to 2.0% by weight.

Particular mention may be made by way of example of those gasoline fuels simultaneously having an aromatics content of not more than 38% or 35% by volume, an olefin content of not more than 21% by volume, a sulfur content of not more than 50 or 10 ppm by weight, a benzene content of not more than 1.0% by volume and an oxygen content of 1.0% to 2.7% by weight.

The content of alcohols and ethers in the gasoline fuel may vary over a wide range. Examples of typical maximum contents are 15% by volume for methanol, 85% by volume for ethanol, 20% by volume for isopropanol, 15% by volume for tert-butanol, 20% by volume for isobutanol, and 30% by volume for ethers having 5 or more carbon atoms in the molecule.

The summer vapor pressure of the gasoline fuel is typically not more than 70 kPa, especially 60 kPa (in each case at 37° C.).

The RON of the gasoline fuel is generally 75 to 105. A typical range for the corresponding MON is 65 to 95.

The specifications mentioned are determined by customary methods (DIN EN 228).

A preferred embodiment of the present invention is that of fuel compositions comprising (A) at least one compound of the formula (I), (II) or (III), preferably (I) or (III) and more preferably (III), (B1) at least one compound having detergent action, preferably at least one compound (B1a), more preferably at least one compound (B1a) which is a polyisobuteneamine obtainable by hydroformylation and subsequent reductive amination, most preferably with ammonia, of polyisobutene with Mn=300 to 5000, (B2) at least one carrier oil, (B3) at least one corrosion inhibitor, (C) at least one gasoline fuel, and optionally at least one alcohol, preferably at least one $C_1$-$C_4$-alkanol, more preferably methanol or ethanol, most preferably ethanol.

The dosage is effected in such a way that the inventive compound (A) is present in the fuel in amounts of 10-5000 ppm by weight, preferably in amounts of 20-2000 ppm by weight, more preferably in amounts of 30-1000 ppm by weight, most preferably in amounts of 40-500 ppm by weight, particularly in amounts of 50-300 ppm by weight and especially in amounts of 10-100 ppm by weight.

The contents of the other coadditives in the fuel are apparent from the amounts specified above for the fuel additive concentrates in relation to component (A).

The amounts in % and ppm that are reported in this document are based, unless stated otherwise, on % by weight and ppm by weight.

The invention is illustrated in detail by the examples described hereinafter without being restricted thereto.

EXAMPLES

Abbreviations, analysis and chemicals used

OHN: hydroxyl number, determined to DIN 53240-1

Total amine value: determined to DIN EN 13716:2001

$M_n$: number-average molecular weight to DIN 55672-1

$M_w$: mass-average molecular weight to DIN 55672-1

D: polydispersity to DIN 55672-1

Potassium contents: determined by ICP-OES

DMAPA: 3-(dimethylamino)propylamine (CAS 109-55-7) from BASF SE

PO: propylene oxide (CAS 75-56-9) from BASF SE

BuO: 1,2-butylene oxide (CAS 106-88-7) from BASF SE

Quadrol L® from BASF SE: ethylenediamine×4PO N,N,N',N'-tetrakis(2-hydroxypropyl)ethylenediamine, CAS 102-60-3

DETA: diethylenetriamine from BASF SE, CAS 111-40-0

Isotridecanol N from BASF SE, CAS 27458-92-0

Ambosol®: hydrated magnesium silicate from PQ Corporation.

Viscosities and densities were determined with a Stabinger viscometer to ASTM D7042.

SYNTHESIS EXAMPLES

Synthesis Example 1: DMAPA×2PO

A 3.5 L pressure autoclave with pitched blade stirrer was initially charged with DMAPA (408.8 g; 4.0 mol) and water (4.1 g, demineralized) and the stirrer was switched on. The reactor was inertized with nitrogen, then heated to 130° C., and nitrogen was used to establish a pressure of 2.0 bar absolute. Propylene oxide (465 g; 8.0 mol) was metered in over a period of 6 h. The mixture was left to react at 130° C. for 6 h and cooled down to 50° C., the reactor was purged with nitrogen and the product was discharged. Then the product was freed of low boilers on a rotary evaporator (90° C./10 mbar/2 h).

$^1$H NMR analysis in $CDCl_3$ confirmed the structure.

Synthesis Example 2: DMAPA×25PO

A 3.5 L pressure autoclave with pitched blade stirrer was initially charged with the product from synthesis example 1 (339 g; 1.55 mol) and 50% aqueous KOH solution (14.5 g) and the stirrer was switched on. This was followed by evacuation to a pressure of 10 mbar and heating to 105° C. for 2 h in order to distill off the water present in the starter mixture. The reactor was inertized with nitrogen, then heated to 130° C., and nitrogen was used to establish a pressure of 2.0 bar absolute. Propylene oxide (2075 g; 35.7 mol) was metered in over a period of 7 h. The mixture was left to react at 130° C. for 10 h and cooled down to 80° C., the reactor was purged with nitrogen and the product was discharged. The product was freed of low boilers on a rotary evaporator (90° C./10 mbar/2 h). Subsequently, 73 g of Ambosol® were added to the product, and the mixture was stirred at 80° C. for 2 h and filtered with the aid of a pressure suction filter (filter medium: Seitz K 150 depth filter). This gave 2412 g of the product (99.9% of theory) in the form of a yellow oil.

OHN 76.3 mg KOH/g, total amine value 67.9 mg KOH/g, DMAPA content by liquid chromatography <0.005%, potassium content <10 ppm, $M_n$ 1658 g/mol, $M_w$ 1891 g/mol, D 1.14, kin. viscosity at 40° C. 113.4 mm$^2$/s.

Synthesis Example 3: DMAPA×15 PO

DMAPA×15 PO was obtained in an analogous manner to synthesis example 2.

OHN 99.9 mg KOH/g, $M_n$ 1026, $M_w$ 1185 g/mol, D 1.15, potassium content <10 ppm.

Synthesis Example 4: Ethylenediamine×25 PO

In an analogous manner to synthesis example 2, ethylenediamine×25 PO was obtained by reacting Quadrol L (ethylenediamine×4PO) with 21 equivalents of PO.

OHN 121.3 mg KOH/g, total amine value 72.2 mg KOH/g, $M_n$ 1804 g/mol, $M_w$ 1902 g/mol, D 1.05, potassium content <10 ppm, dyn. viscosity at 40° C. 198.4 mPas.

Synthesis Example 5: DETA×5 PO

DETA×5 PO was obtained in an analogous manner to synthesis example 1 by propoxylation of DETA.

Synthesis Example 6: DETA×25 PO

DETA×25 PO was obtained in an analogous manner to synthesis example 2 by propoxylation of DETA×5 PO (synthesis example 5).

Synthesis Example 7: DMAPA×2BuO

A 3.5 L pressure autoclave with pitched blade stirrer was initially charged with DMAPA (408.8 g; 4.0 mol) and the stirrer was switched on. The reactor was inertized with nitrogen, then heated to 120° C., and nitrogen was used to establish a pressure of 2.0 bar absolute. 1,2-Butylene oxide (577 g; 8.0 mol) was metered in over a period of 15 h. The mixture was left to react at 120° C. for 6 h and cooled down to 50° C., the reactor was purged with nitrogen and the product was discharged. Then the product was freed of low boilers on a rotary evaporator (90° C./10 mbar/2 h).

$^1$H NMR analysis in $CDCl_3$ confirmed the structure.

Synthesis Example 8: DMAPA×25BuO

A 2 L pressure autoclave with pitched blade stirrer was initially charged with the product from synthesis example 7 (130 g; 0.528 mol) and 50% aqueous KOH solution (6.0 g) and the stirrer was switched on. This was followed by evacuation to a pressure of 10 mbar and heating to 95° C. for 2 h in order to distill off the water present in the starter mixture. The reactor was inertized with nitrogen, then heated to 140° C., and nitrogen was used to establish a pressure of 2.5 bar absolute. 1,2-Butylene oxide (875 g; 12.1 mol) was metered in over a period of 14 h. The mixture was left to react at 140° C. for 4 h and cooled down to 80° C., the reactor was purged with nitrogen and the product was discharged. The product was freed of low boilers on a rotary evaporator (90° C./10 mbar/2 h). Subsequently, 30 g of Ambosol® were added to the product, and the mixture was stirred at 80° C./100 mbar for 2 h and filtered with the aid of a pressure suction filter (filter medium: Seitz K 900 depth filter). The product was obtained in the form of a yellow oil.

OHN 63.7 mg KOH/g, total amine value 49.7 mg KOH/g, $M_n$ 2374 g/mol, $M_w$ 2550 g/mol, D 1.07.

USE EXAMPLES

The following additive package formulations were produced:

| | PIBA* [%] | Carrier oil** [%] | Coadditives*** [%] | Synthesis example 2 [%] | Synthesis example 3 [%] |
|---|---|---|---|---|---|
| Formulation 1 | 44.22 | 26.61 | 29.17 | — | — |
| Formulation 2 | 44.22 | 18.36 | 29.17 | 8.25 | — |
| Formulation 3 | 44.22 | 18.36 | 29.17 | — | 8.25 |
| Formulation 4 | 47.24 | 9.73 | 27.03 | 16.00 | — |

The formulations were monophasic and did not show any phase separation or precipitation on storage at −10° C. over 6 weeks or on storage over −5° C. over 3 months.

| | PIBA* [%] | Carrier oil**** [%] | Synthesis example 8 [%] | Synthesis example 2 [%] |
|---|---|---|---|---|
| Formulation 5 | 64.52 | 35.48 | — | — |
| Formulation 6 | 64.52 | 18.06 | 17.42 | — |
| Formulation 7 | 64.52 | 18.06 | — | 17.42 |

| | PIBA* [%] | Carrier oil** [%] | Solvent, corrosion inhibitor | Synthesis example 2 [%] | Synthesis example 3 [%] |
|---|---|---|---|---|---|
| Formulation 8 | 30.86 | 18.57 | 50.57 | — | — |
| Formulation 9 | 30.01 | 18.06 | 49.15 | 2.78 | — |
| Formulation 10 | 30.01 | 18.06 | 49.15 | — | 2.78 |

*detergent additive obtainable by hydroformylation and amination with polyisobutene having an Mn of 1000
**PO/BuO-based carrier oil
*** friction modifier, solvent and corrosion inhibitor
****PO-based carrier oil Engine Tests Use as Carrier Oil:

Valve Sticking Test in the VW Wasserboxer Engine (CEC F-016-96) at −18° C.:

The testing of the valve sticking performance was undertaken by tests in the VW Wasserboxer test to CEC F-16-T-96. The base fuel used was a Eurosuper fuel to EN 228. The criteria of the test method were used to test for a "pass" (no valve sticking in three successive test runs) or a "fail" (valve sticking in the first, second or third of the successive test runs). Valve sticking becomes noticeable here by virtue of the engine starting only with a delay, if at all. In order to enable a differentiation, testing was deliberately effected in the boundary range of expected valve sticking. The doses of the particular additives specified in ppm by weight (reported as pure substance content, without solvent) are based in each case on the total amount of gasoline fuel formulation used.

Fuel: MIRO 95 OKTAN E10

Formulation 4 at 1000 mg/kg: 3×pass

Formulations 5-7 at 2325 mg/kg: 3×pass

Reduction of Injector Deposits

The engine test was conducted as described in WO 2014/023853, page 22 line 20 to page 23 line 5.

For this purpose, by an in-house method, a commercially available, turbocharged four-cylinder gasoline engine (capacity 1.6 L) with direct injection was with an E0 gasoline comprising 7% by volume of oxygen-containing compounds.

The fuel was admixed with 80 ppm by weight of the products specified from the synthesis examples or formulations and the FR value was determined over the run time. The FR value is a parameter which is established by the engine control system and corresponds to the injection time of the fuel into the combustion space. When the FR value increases in the course of the test run, this indicates deposits at the injection nozzle; the greater the increase, the more deposits have formed. If the FR value, by contrast, remains constant or even falls in the course of a test run, the injection nozzle remains free of deposits.

At the same time, the combustion space deposits are determined (deposits at the top end of the piston: PTD, deposits in the cylinder head: CHD).

Test Run 1: Base Value without Additive

Starting at 0, the FR value falls at first and then reaches 0 again after about 30 hours and reaches a final value of +2.60 after a run time of 50 hours.

Test Run 2: Addition of 80 ppm by Weight of the Compound from Synthesis Example 2 to the Fuel Starting at 0, the FR value falls constantly and reaches a final value of −2.00 after a run time of 50 hours.

Test Run 3: Addition of 80 ppm by Weight of the Compound from Synthesis Example 3 to the Fuel Starting at 0, the FR value falls constantly and—ultimately rising again slightly—reaches a final value of −1.58 after a run time of 50 hours.

Test Run 4: Comparison to EP 700985

Starting at 0 with an unadditized fuel the FR value reaches a value of 7.0 (dirty-up) after 80 h. Thereafter, 65 ppm of PIBA and 55 ppm of polyetheramine according to preparation example B of EP700985 (iso-$C_{13}H_{27}O(CH_2CHEtO)_{21}$—$(CH_2CHEt)$-$NH_2$) are added to the fuel. After a further 20 h of run time, an FR value of 4.1 is attained (clean-up). The relative clean-up is thus 41%.

Test Run 5: Addition of Synthesis Example 2

Starting at 0 with an unadditized fuel the FR value rises and reaches a value of 6.8 (dirty-up) after 60 h. Thereafter, 65 ppm of PIBA, 55 ppm of carrier oil and 55 ppm of synthesis example 2 are added to the fuel. After a further 20 h of run time, an FR value of 2.0 is attained (clean-up). The relative clean-up is thus 71%.

Reduction of Combustion Space Deposits in an M111 (PFI) Engine:

MIRO E10 fuel, 95 octane; test to CEC F-020-98

| | Dosage [mg/kg] | PTD[1)] | CHD[2)] |
|---|---|---|---|
| Formulation 1 | 365 | 2819 | 1609 |
| Formulation 2 | 365 | 2036 | 1071 |
| Formulation 3 | 365 | 2244 | 1051 |

[1)]Piston top deposit;
[2)]cylinder head deposit

Reduction of Combustion Space Deposits in an M111 (PFI) Engine:

MIRO E10 fuel, 95 octane; test to CEO F-020-98

| | Dosage [mg/kg] | PTD[1)] | CHD[2)] |
|---|---|---|---|
| Formulation 8 | 1400 | 4912 | 1152 |
| Formulation 9 | 1440 | 4720 | 940 |
| Formulation 10 | 1440 | 4768 | 1007 |

[1)]Piston top deposit;
[2)]cylinder head deposit

The invention claimed is:

1. A fuel additive concentrate, comprising (A), (B1), (B2), and (B3):

(A) a compound of formula (I) or (II)

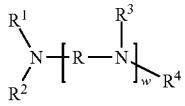

(I)

-continued (II)

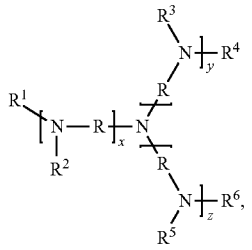

wherein

R is a divalent organic radical, $R^1$, $R^2$, $R^3$, $R^4$, $R^5$, and $R^6$ are independently H, $C_1$- to $C_7$-alkyl, $C_5$- to $C_7$-cycloalkyl, $C_6$- to $C_7$-aryl, or a —[—$X_i$—]$_n$—H radical, $R^1$ and $R^2$ optionally together with the nitrogen atom forming a five- to seven-membered ring, x, y, and z are independently zero or a positive integer, n and w are independently a positive integer, and $X_i$, i being in a range of from 1 to n, is independently —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O—, and/or —$CH(CH_3)$—$CH(CH_3)$—O—, with the provisos that:

a sum total of x, y, and z is non-zero, at least one of $R^1$, $R^2$, $R^3$, $R^4$, $R^5$, and $R^6$ is not H, and at least one of $R^1$, $R^2$, $R^3$, $R^4$, $R^5$, and $R^6$ is —[—$X_i$—]$_n$—H;

(B1) a compound (B1a) which is a polyisobuteneamine obtained by hydroformylation and subsequent reductive amination of polyisobutene with a Mn in a range of from 300 to 5000, (B2) a carrier oil comprising a polyolefin, (poly)ester, (poly)alkoxylate, polyether, aliphatic polyetheramine, alkylphenol-started polyether, alkylphenol-started polyetheramine, and/or carboxylic ester of long-chain alkanol; and (B3) a corrosion inhibitor comprising a monocarboxylic acid having at least 12 carbon atoms, dicarboxylic acid having at least 12 carbon atoms, polycarboxylic acid having at least 12 carbon atoms, ammonium salt of an organic carboxylic acid, and/or heterocyclic aromatic.

2. The concentrate of claim 1, wherein R is 1,2-ethylene, 1,2-propylene, 1,3-propylene, 1,2-butylene, 1,3-butylene, 1,4-butylene, 1,5-pentylene, 1,6-hexylene, 1,8-octylene, or 1,10-decylene.

3. The concentrate of claim 1, wherein $R^1$, $R^2$, $R^3$, $R^4$, $R^5$, and $R^6$, if not —[—$X_i$—]$_n$—H, are independently H or an alkyl radical comprising 1 to 7 carbon atoms.

4. The concentrate of claim 3, wherein $R^1$, $R^2$, $R^3$, $R^4$, $R^5$ and $R^6$, if not —[—$X_i$—]$_n$—H, are independently methyl, ethyl, isopropyl, n-propyl, n-butyl, sec-butyl, or tert-butyl.

5. The concentrate of claim 1, comprising the compound of formula (I).

6. The concentrate of claim 5, wherein x is 1 or 2 and R is 1,2-ethylene, 1,2-propylene, or 1,3-propylene.

7. The concentrate of claim 5, wherein $R^1$ and $R^2$ are independently $C_1$- to $C_4$-alkyl and $R^1$ and $R^4$ are independently a —[—$X_i$—]$_n$—H.

8. The concentrate of claim 7, wherein $X_i$, for i being 1 to n, is independently —$CH_2$—$CH(CH_3)$—O— and/or —$CH(CH_3)$—$CH_2$—O—.

9. The concentrate of claim 1, wherein the compound (A) is of formula (III)

(III)

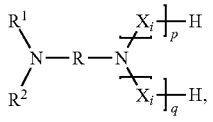

wherein $R^1$, $R^2$, and $X_i$ are as defined in claim 1, and p and q are independently a positive integer.

10. The concentrate of claim 9, wherein, in the compound (A) of formula (III):

(IIIa) R is 1,2-ethylene and $R^1$ and $R^2$ are methyl;

(IIIb) R is 1,2-ethylene and $R^1$ and $R^2$ are ethyl;

(IIIc) R is 1,2-ethylene and $R^1$ and $R^2$ are n-butyl;

(IIId) R is 1,2-ethylene and $R^1$ and $R^2$ are collectively a 1,4-butylene chain;

(IIIe) R is 1,2-ethylene and $R^1$ and $R^2$ are collectively a 1,5-pentylene chain;

(IIIf) R is 1,2-ethylene and $R^1$ and $R^2$ are collectively a 3-oxa-1,5-pentylene chain;

(IIIg) R is 1,2-propylene and $R^1$ and $R^2$ are methyl;

(IIIh) R is 1,2-propylene and $R^1$ and $R^2$ are ethyl;

(IIIi) R is 1,2-propylene and $R^1$ and $R^2$ are n-butyl;

(IIIj) R is 1,2-propylene and $R^1$ and $R^2$ are collectively a 1,4-butylene chain;

(IIIk) R is 1,2-propylene and $R^1$ and $R^2$ are collectively a 1,5-pentylene chain;

(IIIl) R is 1,2-propylene and $R^1$ and $R^2$ are collectively a 3-oxa-1,5-pentylene chain;

(IIIm) R is 1,3-propylene and $R^1$ and $R^2$ are methyl;

(IIIn) R is 1,3-propylene and $R^1$ and $R^2$ are ethyl;

(IIIo) R is 1,3-propylene and $R^1$ and $R^2$ are n-butyl;

(IIIp) R is 1,3-propylene and $R^1$ and $R^2$ are collectively a 1,4-butylene chain;

(IIIq) R is 1,3-propylene and $R^1$ and $R^2$ are collectively a 1,5-pentylene chain; or (IIIr) R is 1,3-propylene and $R^1$ and $R^2$ are collectively a 3-oxa-1,5-pentylene chain.

11. The concentrate of claim 1, wherein a sum total of p and q is in a range of from 2 to 50.

12. The concentrate of claim 1, comprising the compound of formula (I), wherein:

(Ia) R is 1,2-ethylene, w is 1, $R^1$ to $R^3$ are methyl, and $R^4$ is —[—$X_i$—]$_n$—H;

(Ib) R is 1,2-ethylene, w is 1, $R^1$ and $R^2$ are methyl, and $R^3$ and $R^4$ are independently —[—$X_i$—]$_n$—H;

(Ic) R is 1,2-propylene, w is 1, $R^1$ and $R^2$ are methyl, and $R^3$ and $R^4$ are independently —[—$X_i$—]$_n$—H;

(Id) R is 1,3-propylene, w is 1, $R^1$ and $R^2$ are methyl, and $R^3$ and $R^4$ are independently —[—$X_i$—]$_n$—H;

(Ie) R is 1,3-propylene, w is 1, $R^1$ and $R^2$ are ethyl, and $R^3$ and $R^4$ are independently —[—$X_i$—]$_n$—H;

(If) R is 1,3-propylene, w is 1, $R^1$ and $R^2$ are n-butyl, and $R^3$ and $R^4$ are independently —[—$X_i$—]$_n$—H; or (Ig) R is 1,2-ethylene, w is 1, $R^1$ to $R^4$ are —[—$X_i$—]$_n$—H.

13. The concentrate of claim 1, comprising the compound of formula (II), wherein:

(IIa) R is 1,2-ethylene, x and y are 1, z is 0, and $R^1$ to $R^4$ and $R^6$ are independently —[—$X_i$—]$_n$—H;

(IIb) R is 1,2-propylene, x and y are 1, z is 0, and $R^1$ to $R^4$ and $R^6$ are independently —[—$X_i$—]$_n$—H; or (IIc) R is 1,3-propylene, x and y are 1, z is 0, and $R^1$ to $R^4$ are independently —[—$X_i$—]$_n$—H, and $R^6$ is $C_1$- to $C_2$-alkyl.

14. The concentrate of claim 1, wherein, in at least one of $R^1$, $R^2$, $R^3$, $R^4$, $R^5$, and $R^6$, X in $X_i$ is —$CH_2$—$C(CH_3)_2$—O— and/or —$C(CH_3)_2$—$CH_2$—O—.

15. The concentrate of claim 1, wherein, in at least one of $R^1$, $R^2$, $R^3$, $R^4$, $R^5$, and $R^6$, X in X is —$CH_2$—$CH(C_2H)$—O— and/or —$CH(C_2H_5)$—$CH_2$—O— or —$CH(CH_3)$—$CH(CH_3)$—O—.

16. A fuel composition, comprising (A), (B1), (B2), (B3), (C), and optionally (D):

(A) a compound of formula (I) or (II)

(I)

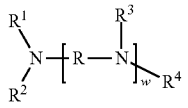

(II)

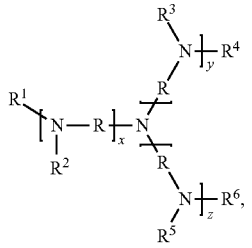

wherein

R is a divalent organic radical, $R^1$, $R^2$, $R^3$, $R^4$, $R^5$ and $R^6$ are independently H, $C_1$- to $C_7$-alkyl, $C_5$- to $C_7$-cycloalkyl, $C_6$- to $C_7$-aryl or a —[—$X_i$—]$_n$—H radical, $R^1$ and $R^2$ optionally together with the nitrogen atom forming a five- to seven-membered ring, x, y, and z are independently zero or a positive integer, n and w are independently a positive integer, and $X_i$, i being in a range of from 1 to n, is independently —$CH_2$—$CH(CH_3)$—O—, —$CH(CH_3)$—$CH_2$—O—, —$CH_2$—$C(CH_3)_2$—O—, —$C(CH_3)_2$—$CH_2$—O—, —$CH_2$—$CH(C_2H_5)$—O—, —$CH(C_2H_5)$—$CH_2$—O—, and/or —$CH(CH_3)$—$CH(CH_3)$—O—, with the provisos that:

a sum total of x, y, and z is non-zero, at least one of $R^1$, $R^2$, $R^3$, $R^4$, $R^5$, and $R^6$ is not H, and at least one of $R^1$, $R^2$, $R^3$, $R^4$, $R^5$, and $R^6$ is —[—$X_i$—]$_n$—H;

(B1) a compound having detergent action;

(B2) a carrier oil comprising a polyolefin, (poly)ester, (poly)alkoxylate, polyether, aliphatic polyetheramine, alkylphenol-started polyether, alkylphenol-started polyetheramine, and/or carboxylic ester of long-chain alkanol;

(B3) a corrosion inhibitor comprising a monocarboxylic acid having at least 12 carbon atoms, dicarboxylic acid having at least 12 carbon atoms, polycarboxylic acid having at least 12 carbon atoms, ammonium salt of an organic carboxylic acid, and/or heterocyclic aromatic;

(C) a gasoline fuel; and (D) optionally, an alcohol.

17. The composition of claim 16, wherein, in at least one of $R^1$, $R^2$, $R^3$, $R^4$, $R^5$, and $R^6$, X in $X_i$ is —$CH_2$—$CH(CH_3)$—O— and/or —$C(CH_3)_2$—$CH_2$—O—.

18. The composition of claim 16, wherein, in at least one of $R^1$, $R^2$, $R^3$, $R^4$, R, and $R^6$, X in $X_i$ is —$CH_2$—$C(CH_3)_2$—O— and/or —$C(CH_3)_2$—$CH_2$—O—.

19. The composition of claim 16, wherein, in at least one of $R^1$, $R^2$, $R^3$, $R^4$, $R^5$, and $R^6$, X in $X_i$ is —$CH_2$—$CH(C_2H)$—O— and/or —$CH(C_2H_5)$—$CH_2$—O— or —$CH(CH_3)$—$CH(CH_3)$—O—.

20. The composition of claim 16, wherein, when admixed with 55 ppm by weight, improves the FR value relative to a fuel formulation comprising (iso-$C_{13}H_{27}O(CH_2CHEtO)_{21}$—$(CH_2CHEt)$-$NH_2$) in place of the compound (A).

* * * * *